US010722046B1

(12) United States Patent
Poslowski et al.

(10) Patent No.: US 10,722,046 B1
(45) Date of Patent: Jul. 28, 2020

(54) ADJUSTABLE HEIGHT CHILD SEAT

(71) Applicant: Foundations Worldwide, Inc., Medina, OH (US)

(72) Inventors: Lukasz S. Poslowski, Medina, OH (US); Timothy Scarcella, Huntersville, NC (US); David Stitchick, Norton, OH (US)

(73) Assignee: Foundations Worldwide, Inc., Medina, OH (US)

( * ) Notice: Subject to any disclaimer, the term of this patent is extended or adjusted under 35 U.S.C. 154(b) by 0 days.

(21) Appl. No.: 15/973,751

(22) Filed: May 8, 2018

Related U.S. Application Data

(60) Provisional application No. 62/504,784, filed on May 11, 2017.

(51) Int. Cl.
*A47B 83/02* (2006.01)
*A47D 1/00* (2006.01)
*A47D 1/04* (2006.01)

(52) U.S. Cl.
CPC ..... *A47D 1/004* (2013.01); *A47D 1/0085* (2017.05); *Y10T 16/209* (2015.01)

(58) Field of Classification Search
CPC ..... Y10T 16/209; A47D 1/004
USPC ..... 297/148–156, 344.18, 440.24, 256.16; 248/188.8, 188.9, 346.11
See application file for complete search history.

(56) References Cited

U.S. PATENT DOCUMENTS 2,327,050 A * 8/1943 Kotler ..... A47B 91/024 248/188.4
2,790,484 A * 4/1957 Pollack ..... A47D 1/06 297/153 X
4,452,484 A * 6/1984 Pastor ..... A47D 13/04 297/150 X
4,772,068 A * 9/1988 Gleckler ..... A47C 7/002 248/188.5
4,842,331 A * 6/1989 Waples ..... A47D 1/008 297/149
4,946,180 A * 8/1990 Baer ..... A47D 1/008 297/155 X
5,131,715 A * 7/1992 Balles ..... A61H 3/04 297/148 X
5,494,333 A * 2/1996 Wilson ..... A47C 7/002 297/344.18 X
5,507,550 A * 4/1996 Maloney ..... A47D 1/002 297/344.18 X
5,516,197 A * 5/1996 Condos ..... A47C 3/38 297/344.18
5,782,444 A * 7/1998 Anderman ..... A47B 91/06 248/188.8 X (Continued)

*Primary Examiner* — Rodney B White
(74) *Attorney, Agent, or Firm* — Ralph E. Jocke; Colin P Cochran; Walker & Jocke

(57) ABSTRACT

A height adjustable child seat (10) includes a generally rectangular body (12) which includes a seat recess (18). The child seat is supported by four legs (24) each of which includes an upper leg (26) and a lower leg (32) that extend in telescoping relation. Each leg includes a releasable latch (34) including a positioning projection (36) which is selectively engageable in axially disposed positioning apertures (38). Each leg is in connection with a foot (50) which includes a disc (56) with an overlying tread layer (66). The child seat includes a child holding harness (78) that includes at least one flat plastic band that has smooth surfaces on all sides thereof.

30 Claims, 11 Drawing Sheets

(56) References Cited

U.S. PATENT DOCUMENTS 5,845,962 A * 12/1998 Lin ..... A47C 4/02 297/440.24 X
5,865,542 A * 2/1999 Ryu ..... A47C 3/30 297/344.18 X
5,882,067 A * 3/1999 Carbajal ..... A61H 3/00 297/344.18 X
6,056,353 A * 5/2000 Meara ..... A61G 5/08 297/344.18
6,138,979 A * 10/2000 Morman ..... A47B 91/00 248/188.9 X
6,155,530 A * 12/2000 Borgen ..... H04R 1/026 248/188.9 X
6,293,623 B1 * 9/2001 Kain ..... A47D 1/004 297/153 X
6,520,459 B2 * 2/2003 Burr ..... A47B 91/066 248/188.8 X
6,742,750 B2 * 6/2004 Burr ..... A47B 91/066 248/188.8 X
6,905,172 B1 * 6/2005 Barnett ..... A47C 7/002 297/344.18 X
6,910,666 B2 * 6/2005 Burr ..... A47B 91/066 248/188.8 X
6,921,135 B2 * 7/2005 Ellis ..... A47C 1/023 297/344.18
6,938,872 B2 * 9/2005 Nygaard ..... F16M 7/00 248/188.8
7,121,620 B1 * 10/2006 Fang ..... A47C 3/34 297/440.24 X
7,380,879 B2 * 6/2008 Fletcher ..... A47C 3/12 248/188.8 X
7,497,518 B2 * 3/2009 Fritz ..... A47D 1/002 297/148
7,549,702 B2 * 6/2009 Meyers ..... A47K 3/122 297/344.18 X
7,673,940 B2 * 3/2010 Fritz ..... A47D 1/004 297/250.1
7,762,506 B2 * 7/2010 Beshore ..... A47B 91/06 248/188.8 X
8,141,841 B2 * 3/2012 von Lillienskjold ... F16F 1/445 248/188.8 X
8,166,990 B2 * 5/2012 Daily ..... A45B 7/00 248/188.9 X
8,794,699 B1 * 8/2014 Rudolfo ..... A47C 4/20 297/344.18 X
9,039,077 B1 * 5/2015 Santamaria ..... A47C 1/146 297/344.18 X
2001/0019096 A1 * 9/2001 Andreoli ..... F16M 7/00 248/188.8
2003/0102700 A1 * 6/2003 Lin ..... A47C 3/34 297/344.18 X
2005/0179304 A1 * 8/2005 Serhan ..... A47K 3/282 297/440.24
2010/0314914 A1 * 12/2010 Mazzola ..... A47C 3/34 297/344.18 X

* cited by examiner

ADJUSTABLE HEIGHT CHILD SEAT

TECHNICAL FIELD

Exemplary embodiments relate to the field of children's furniture. Exemplary embodiments further relate to a height adjustable child seat.

BACKGROUND

Child seats have many drawbacks. Children often quickly outgrow them. Children can cause the seats to flip or may fall out of them. Child seats can become soiled with food or other material. Child seats and similar items may benefit from improvements.

SUMMARY

It is an object of the exemplary embodiments to provide a child seat that is height adjustable and with improved features and functions.

DETAILED DESCRIPTION

Figure 1:
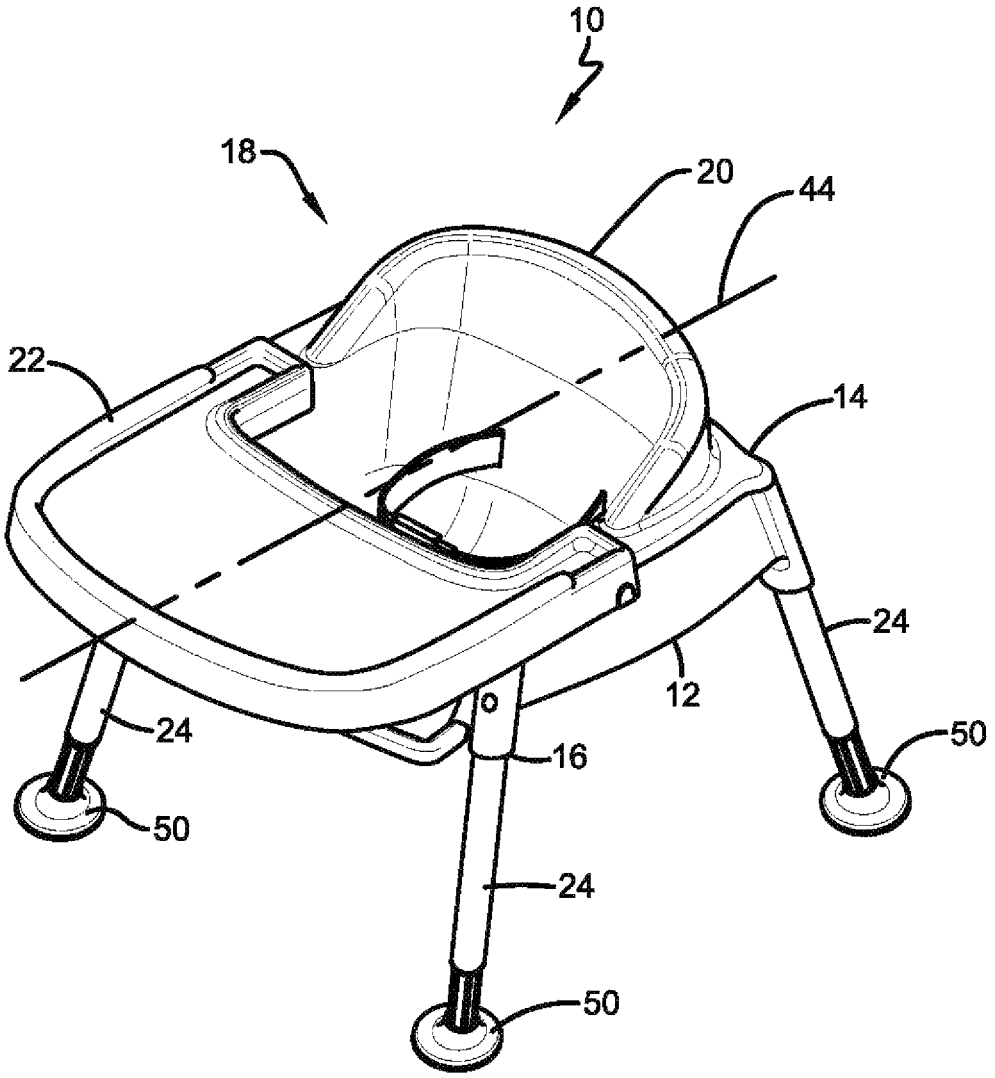
FIG. 1 is a perspective view of a child seat of an exemplary embodiment.
Figure 2:
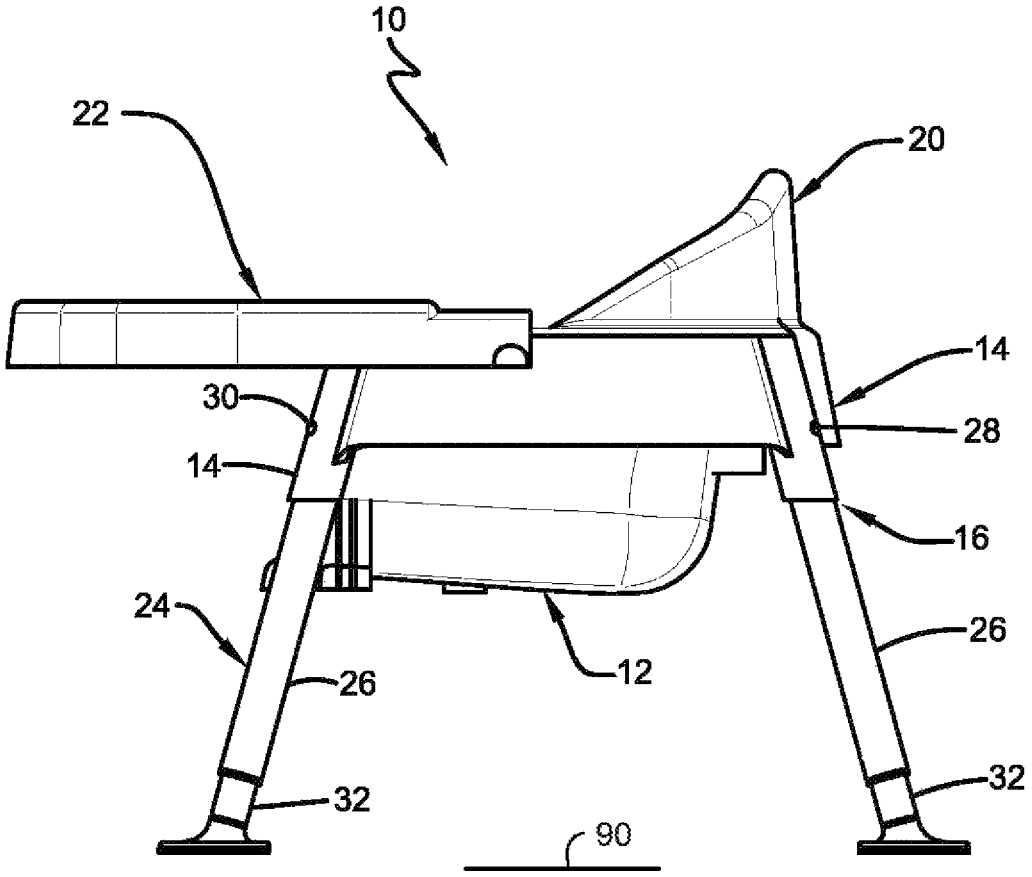
FIG. 2 is a side view of the exemplary child seat.

Referring now to the drawings and particularly to FIG. 1 there is shown therein an exemplary embodiment of a child seat 10. Child seat 10 includes a generally rectangular body 12. Body 12 includes four disposed corner areas 14. Each of the corner areas includes a vertically extending cylindrical body recess 16. Rectangular body 12 further includes a centrally located seat recess 18. The seat recess is configured to receive therein the rump of a child. The exemplary child seat also includes a seat back 20. The child seat further includes a tray 22 which is releasably engageable with the body 12.

Child seat 10 includes four outwardly and downwardly extending legs 24. Each leg is configured to extend outwardly at an angle from a respective corner area of body 12. Each leg 24 includes an upper leg 26. Each upper leg 26 extends vertically in close-fitting relation within a respective cylindrical body recess 16. Each upper leg 26 includes an outwardly extending body engaging projection 28. In the exemplary embodiment each body engaging projection comprises an outwardly biased button projection that engages a body engaging aperture 30 that extends through the respective cylindrical body recess 16. In the exemplary embodiment the engagement of the body engaging projection 28 and the body engaging aperture 30 releasably holds the upper leg in engagement with the body and in the cylindrical body recess 16. This exemplary configuration also enables each leg to be engaged and disengaged from the body 12 for purposes of assembly, disassembly, transport or cleaning.

Each leg of the exemplary child seat further includes a lower leg 32. Each lower leg is engaged with a corresponding upper leg in telescoping relation. In the exemplary arrangement the lower leg extends within the upper leg so as to enable varying the vertical height of each leg. Each upper and lower leg includes a releasable latch 34 in operative connection therewith. In exemplary embodiments the releasable latch is operatively connected with the upper and lower leg and is operative to releasably selectively hold the upper and lower leg in a plurality of telescoping positions.

In the exemplary embodiment the releasable latch 34 associated with each of the legs 24 includes a positioning projection 36. Each positioning projection is radially outwardly biased from the lower leg 32. The positioning projection 36 is selectively engageable in a plurality of axially disposed positioning apertures 38 which extend in the upper leg 26.

Figure 6:
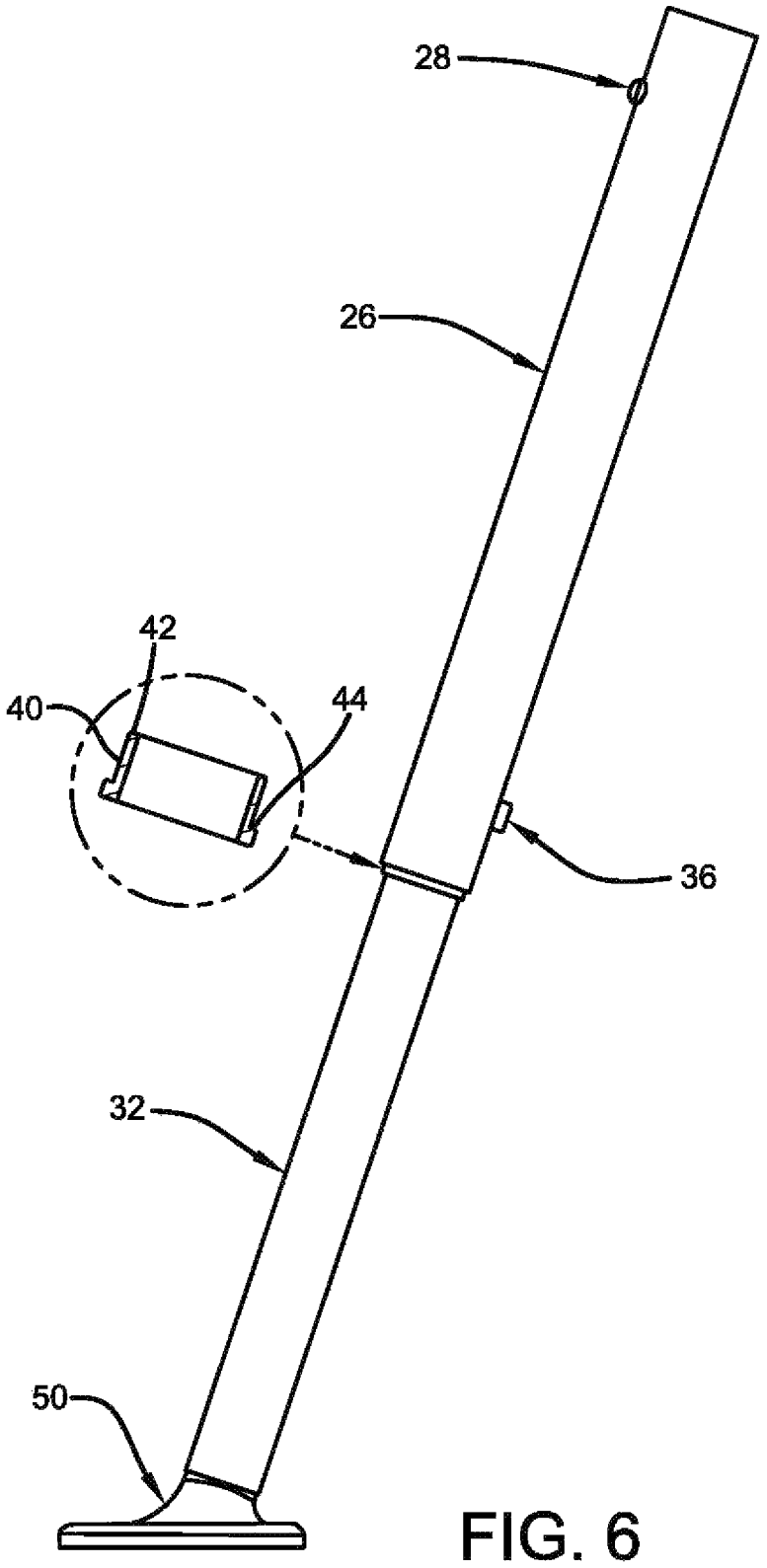
FIG. 6 is a side view of the exemplary leg.

In the exemplary arrangement an annular bushing 40 of unitary plastic construction is positioned between the upper and lower legs. In the exemplary arrangement the bushing 40 in transverse cross-section as shown in FIG. 6 includes an inside annular portion 42. The inside annular portion extends inside the upper leg and overlies the lower leg. The exemplary bushing 40 in cross-section also includes an annular step 44. The annular step in transverse cross section extends perpendicular to the inside annular portion of the bushing and abuts an annular edge of the upper leg 26. In the exemplary embodiment the bushing is comprised of nylon plastic. However, in other embodiments other materials may be used.

As can be appreciated in the exemplary arrangement the user is enabled to vary the axial length of the engaged upper leg and lower leg by changing the respective positioning aperture in which the respective positioning projection is engaged. The child seat of the exemplary embodiment is enabled to selectively change the height of a bottom 92 of the seat recess 18 to be at 5, 7, 9, 11 or 13 inches from a horizontal floor 90. This enables the height of the exemplary child seat to be changed in accordance with the size and growth of the child, adjusted for greater structural stability, as well as conforming to various table heights. Of course, it should be understood that these height dimensions are exemplary and in other embodiments other approaches may be used.

In an exemplary arrangement the rectangular body has a width distance in a direction perpendicular to direction line 44. The width distance is across the widest area of the body. In exemplary embodiments, the width distance is about 20 inches. Of course, it should be understood that the width dimension is exemplary and in other embodiments other approaches may be used.

In exemplary arrangements the ratio between the width distance of the rectangular body compared to the distance to the floor 90 from the seat body bottom 92 is in the range of about 4:1 to about 1.5:1.

In the exemplary arrangement the legs are configured so that the upper leg is the outside leg of the telescoping pair while the lower leg is the inside leg. In other arrangements this configuration may be reversed so that the lower leg extends outside the upper leg in telescoping relation. In such arrangements the positioning projection may extend from the upper leg while the lower leg may have the positioning apertures disposed therein. Further it should be understood that in the exemplary arrangement the bushing is configured to facilitate the relative movement of the upper leg and the lower leg in telescoping relation without significant transverse play between the two legs. This provides a stable platform for the exemplary child seat. Further in the event that the plastic bushing should fracture or become displaced from its operative position, the bushing will tend to move downward on the lower leg 32. The displaced bushing will not become a loose item that may be swallowed or otherwise cause harm to a child. Of course, it should be understood that this approach is exemplary and in other embodiments other approaches may be used.

Figure 4:
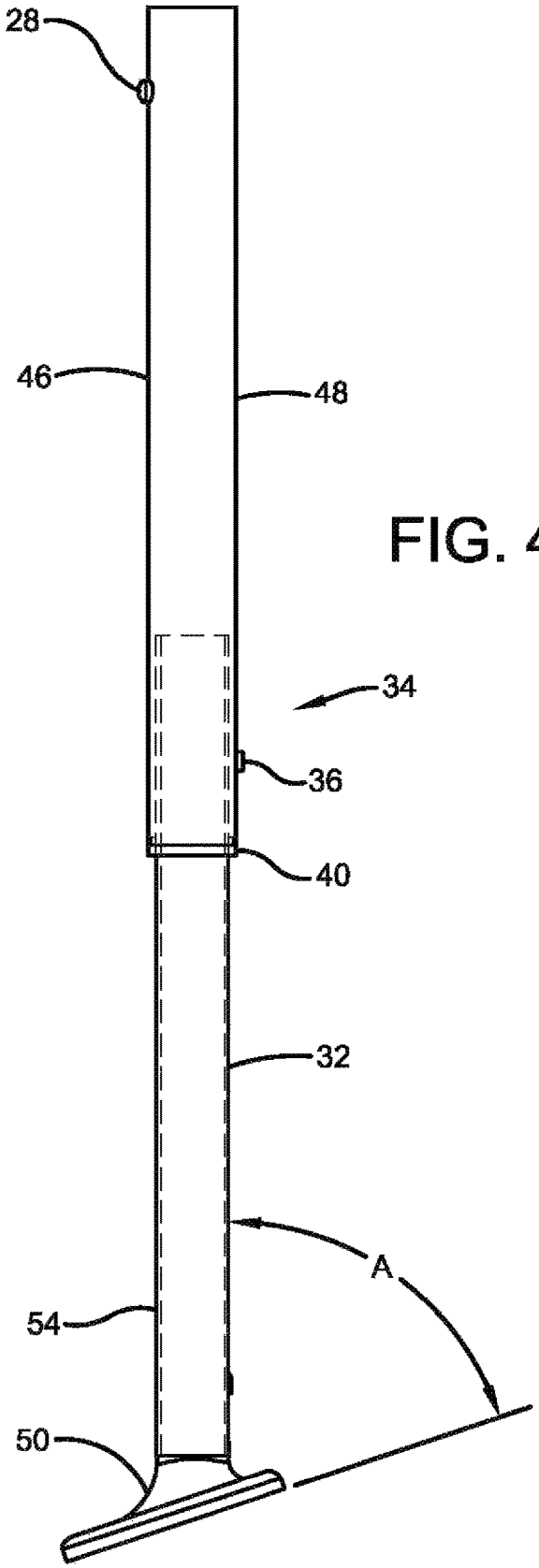
FIG. 4 is a side view of an exemplary leg of the child seat.
Figure 5:
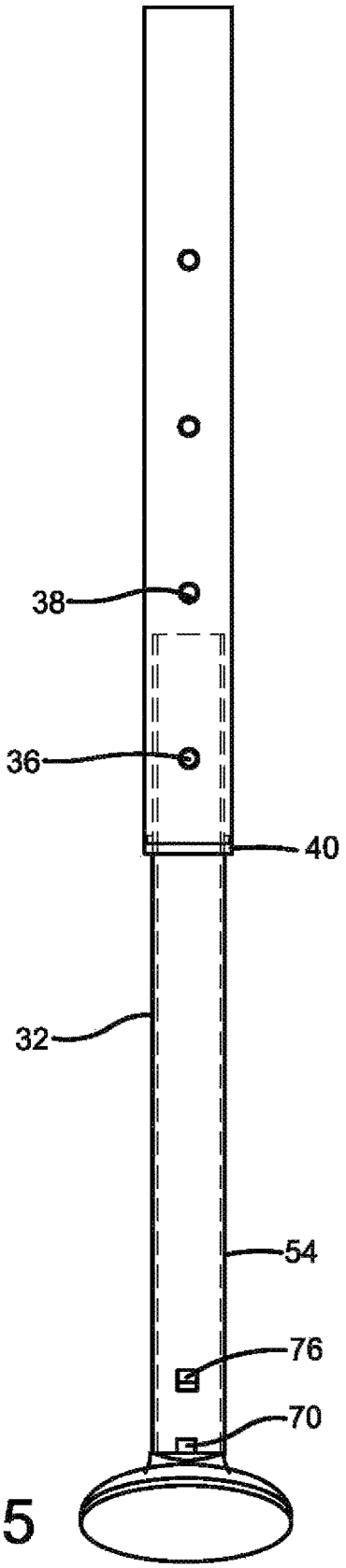
FIG. 5 is a back view of the exemplary leg.

In the exemplary arrangement when in use a child that is seated in the body recess 16 faces along a direction line indicated 44 in FIG. 1. Direction line 44 bisects the body and corresponds to the direction that a child would face when positioned in the seat recess 16 due to the position of the leg openings in the rectangular body 12 and the seat back 20. As shown in FIGS. 4 and 5, each leg includes a semi annular outward facing half 46 and a semi annular back half 48. In the case of each leg 24 the semi annular outward facing half has a center portion that faces in a facing direction that is parallel to direction line 44 and away from rectangular body 12. As can be appreciated, the outward facing half 46 of each of the legs positioned to extend the front of the child seat 10 which generally extends under the tray 22, faces in a forward direction relative to the seat recess. Each back half of the legs that extend from the front of the child seat includes the positioning apertures 38 therein.

In the exemplary arrangement each of the rear legs of the child seat have the semi annular outward facing half extending rearward relative to the seat recess 16. Each back half of the rear legs which includes the positioning apertures 36 therein, is positioned generally facing the back half of a respective leg on the same side of the body that extends in a forward direction.

In this exemplary arrangement because the positioning apertures for each of the legs 24 are positioned inwardly relative to the annular outward facing half 46 of each of the legs, it is less likely that a child will catch its fingers or other articles in the positioning apertures. In the exemplary arrangement this reduces the risk of cuts or injury to the child. Of course it should be understood that this approach is exemplary and in other embodiments other approaches may be used.

Figure 7:
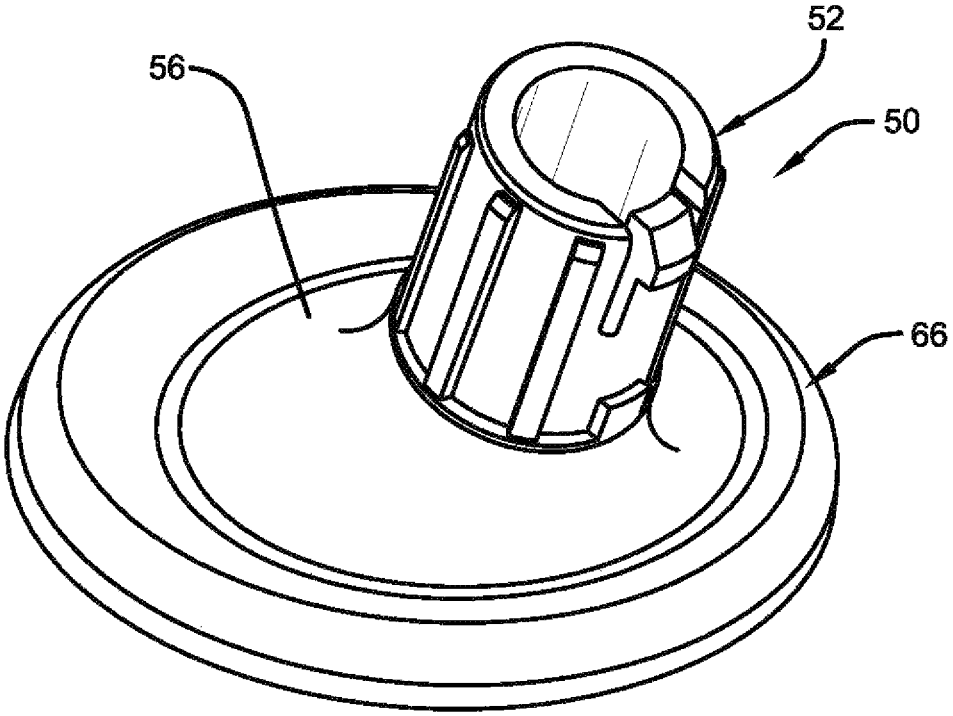
FIG. 7 is a top back perspective view of an exemplary foot of a leg.
Figure 8:
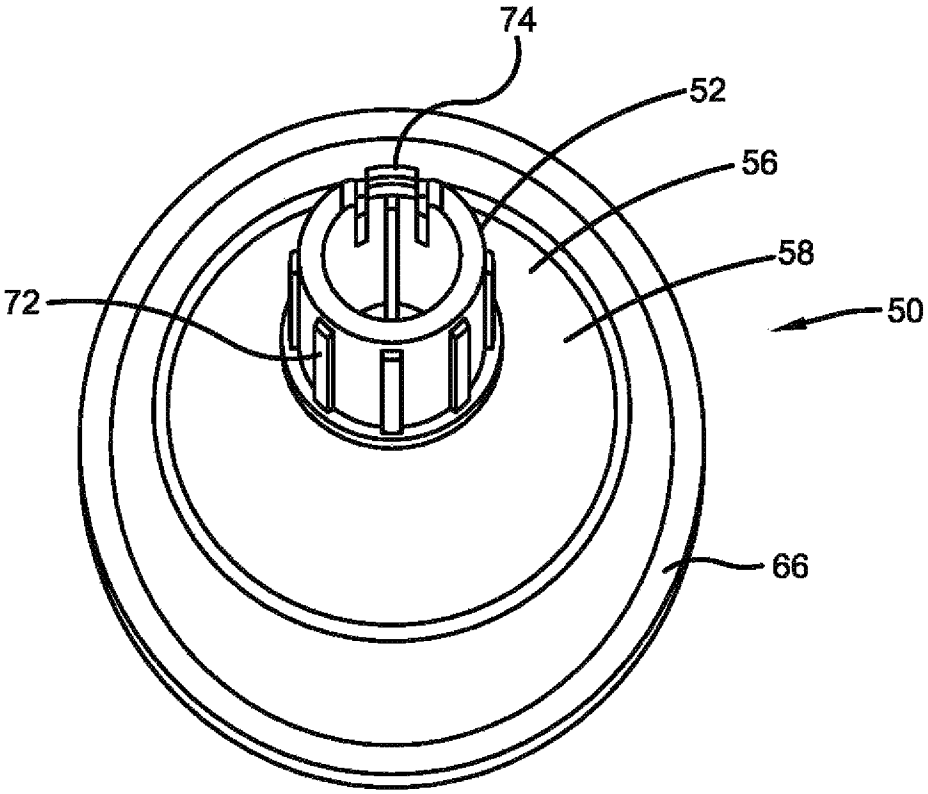
FIG. 8 is a top perspective view of the exemplary foot.
Figure 9:
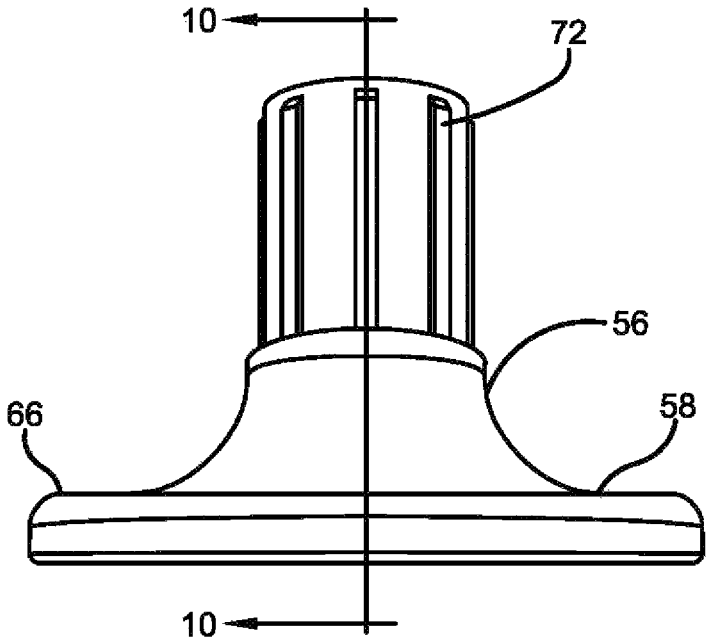
FIG. 9 is a front view of the exemplary foot.

In the exemplary child seat arrangement positioned at the lower end of each of the legs 24 is a foot 50. As shown in FIG. 7 each exemplary foot 50 includes an angled upward extending stem 52. The upward extending stem 52 extends within a stem opening (not separately shown) in a leg lower portion 54 of each lower leg 32. Each exemplary foot 50 includes a disc 56 which is comprised of a relatively hard plastic material such as nylon. In the exemplary arrangement the stem 52 and the disc are formed as a single molded body.

Figure 10:
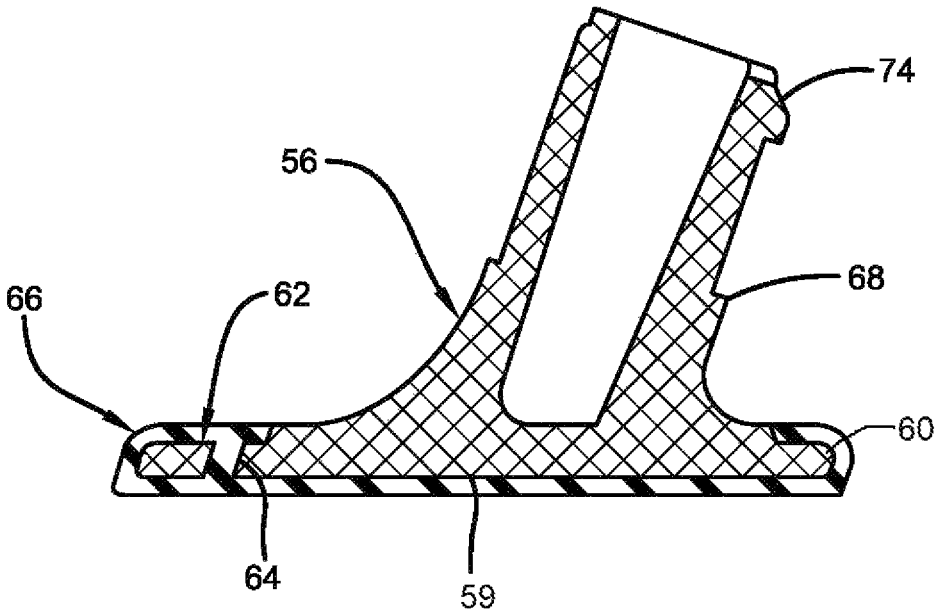
FIG. 10 is a cross-sectional view of the foot taken along line 10-10 in FIG. 9.
Figure 11:
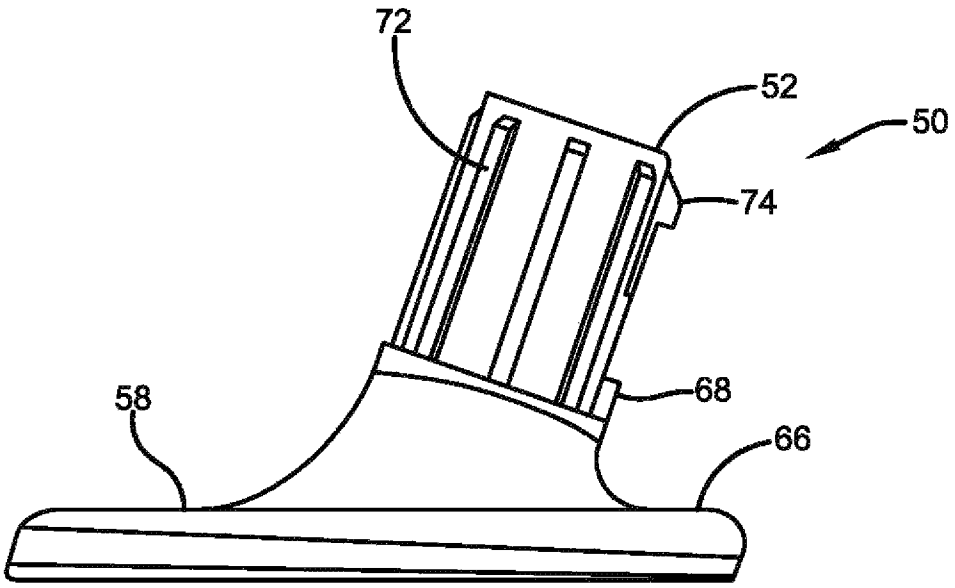
FIG. 11 is a side view of the exemplary foot.
Figure 12:
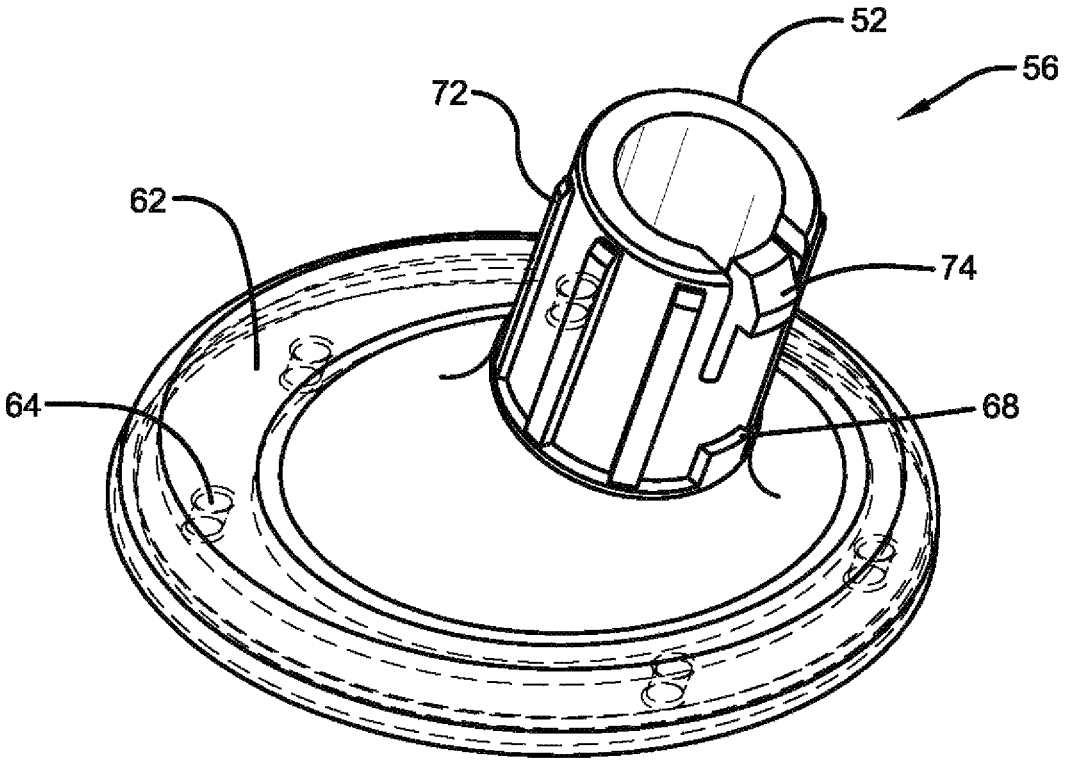
FIG. 12 is a perspective view of the disc of the exemplary foot.

The disc includes a disc top 58 and a disc bottom 59. The disc further includes an annular disc periphery 60. As shown in FIGS. 10 and 12 the exemplary disc 56 includes an annular recess 62. Recess 62 extends downward relative to the disc top 58 and inwardly from the periphery 60. A plurality of foot apertures 64 extend through the disc 56 between the disc top and the disc bottom in the area of the recess 62.

The exemplary foot 50 further includes a unitary tread layer 66. The unitary tread layer 66 in an exemplary embodiment is comprised of relatively softer material than the disc 56. In the exemplary arrangement the tread layer extends across the disc bottom 59, around the disc periphery 60 and above the disc top 58 in the area of the recess 62. In the exemplary arrangement the tread layer 66 extends through the plurality of disc apertures 64. In the exemplary foot 50 the tread layer across the bottom of the foot and which comprises the foot bottom that engages the floor, is generally smooth. However in other arrangements the tread layer on the bottom of the foot may include grooves, projections or other structures that facilitate gripping engagement of the foot with the floor or other supporting structure. In the exemplary arrangement the tread layer and the disc are each comprised of plastic materials that are joined in heat fused fixed engagement. This approach reduces the risk that the tread layer will separate from the disc 56. Of course this approach is exemplary and in other embodiments other approaches may be used.

In the exemplary foot construction, the stem 52 extends at an angle relative to the disc 56 so that the leg 24 connected to the foot 50 will extend at an angle of about 70° when the foot is flatly engaged with a floor or other supporting surface. This is represented by Angle A in FIG. 4. Of course this approach is exemplary and in other arrangements other approaches may be used.

The stem 52 of each foot 50 includes a radially extending alignment projection 68. As shown in FIG. 5 each leg lower portion 54 includes an axially extending alignment projection engaging recess 70. The projection engaging recess intersects with the stem opening at the bottom of the leg lower portion. Recess 70 is sized to accept alignment projection 68 therein. The engagement of the alignment projection in the projection engaging recess 70 is operative to hold the foot in a fixed rotational position relative to the lower leg 32. This configuration helps to provide stability to the legs 24 which support the child seat 10.

Each stem portion 52 of each foot 50 further includes a plurality of angularly spaced and radially extending positioning projections 72. In the exemplary arrangement the positioning projections 72 extend further radially outwardly with increasing proximity to disc top 58. This configuration of the positioning projections 72 facilitates the engagement of such projections with the inner annular surface bounding the interior of the leg lower portion 54. The positioning projections help to hold the stem in solid fixed engagement with the leg lower portion.

The exemplary stem 52 of each foot 50 further includes an outwardly extending locking projection 74. The exemplary locking projection is resilient and radially outwardly biased on the stem 52. The locking projection 74 of the exemplary arrangement further includes an angled upper surface and a generally flat lower catch surface to facilitate the insertion of the stem and the locking projection within the interior of the leg lower portion 54. As shown in FIG. 5 the leg lower portion includes a locking aperture 76. The exemplary locking aperture 76 is axially disposed and separate from the stem opening which accepts the stem into the bottom of the leg lower portion. The locking aperture 76 is configured to accept the locking projection 74 therein when the stem is fully axially extended upwardly within the leg lower portion. The engagement of the catch surface of the locking projection 74 in the locking aperture 76 reduces the risk that the foot 50 will separate from the respective leg 24. The construction of the exemplary embodiment of the foot 50 which includes the alignment projection 68 and recess as well as the positioning projections 72 and the locking projection 74 and locking aperture 76, provides solid firm engagement between the foot 50 and the lower leg 32. Of course this construction is exemplary and in other embodiments other approaches may be used.

Figure 3:
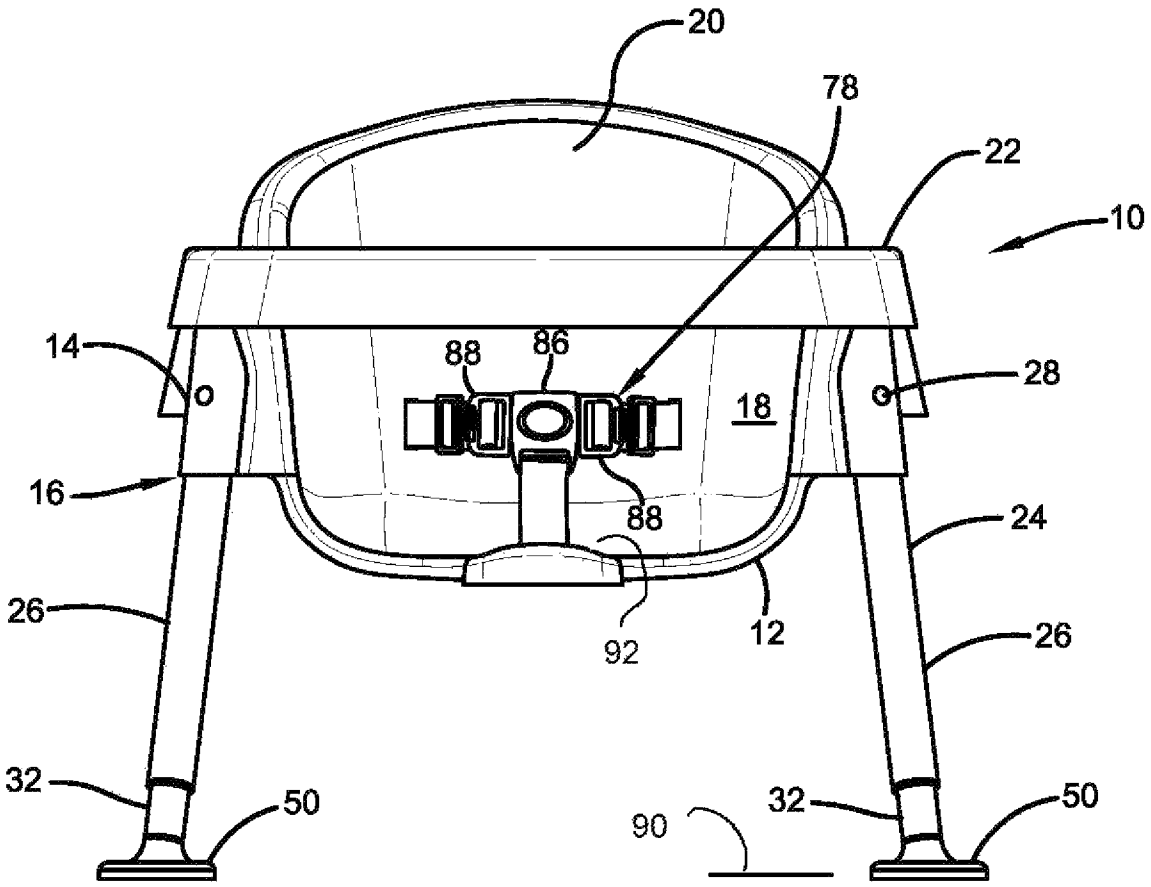
FIG. 3 is a front view of the exemplary child seat.
Figure 13:
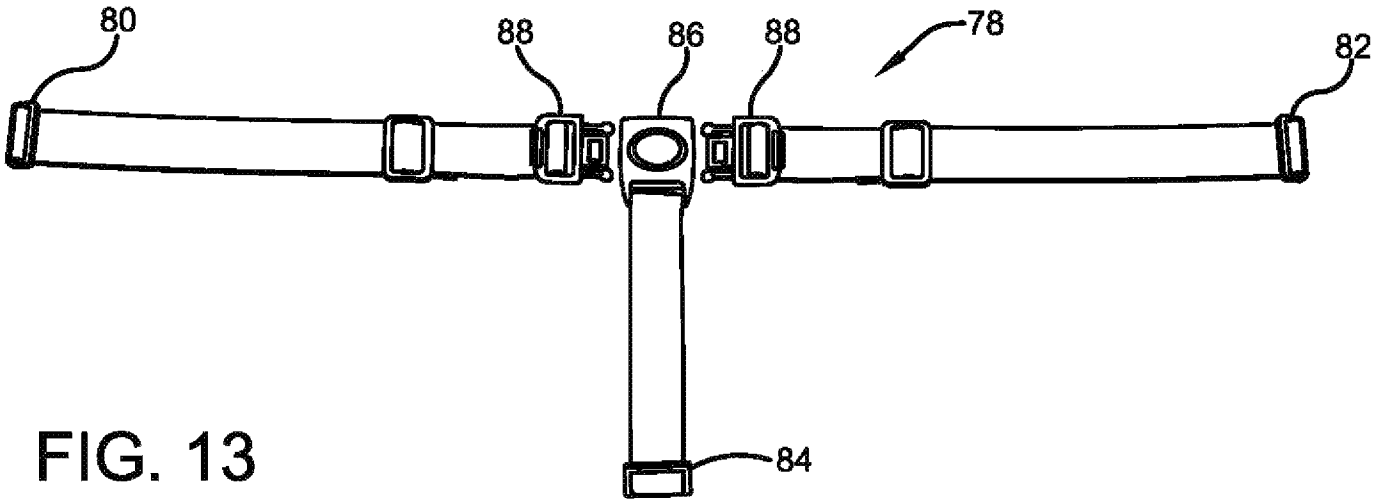
FIG. 13 is a front plan view of an exemplary harness of the exemplary child seat.
Figure 15:
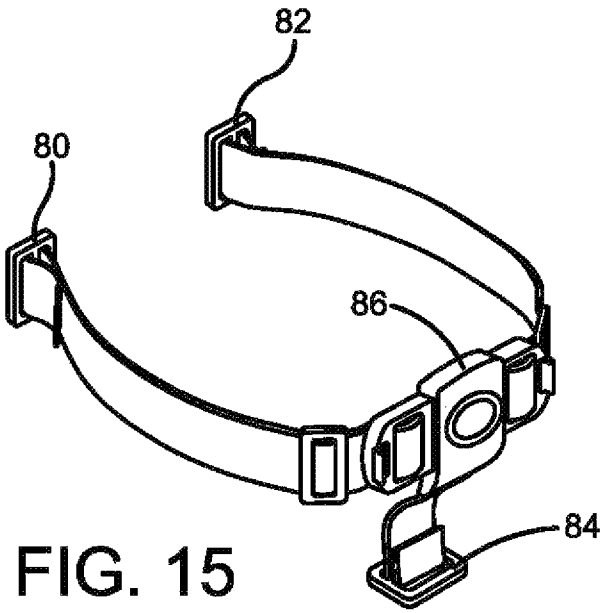
FIG. 15 is a top perspective view of the exemplary harness.
Figure 14:
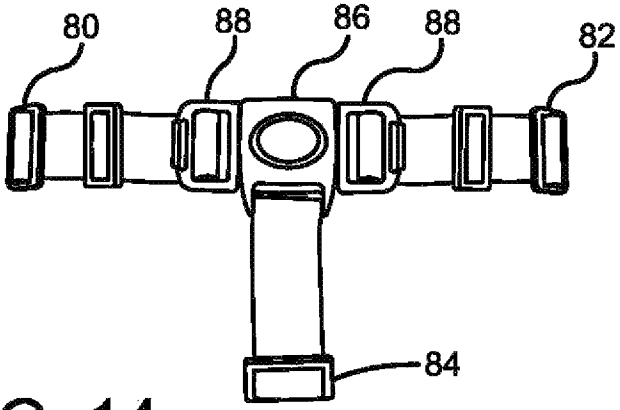
FIG. 14 is a front view of the exemplary harness in a curved position.

As shown in FIG. 3 the exemplary child seat includes a harness 78. Harness 78 is a releasable harness that is configured to hold the child within the seat recess. The exemplary harness as shown in FIG. 13 includes three branches which terminate in engagement with side clips 80 and 82 and bottom clip 84. In the exemplary embodiment the side clips 80, 82 and the bottom clip 84 are releasably firmly engageable with latching recesses that extend in the body 12. The exemplary harness 78 further includes a central clip 86 that enables an adult to selectively release a child that is engaged in the child seat from the harness 78. In exemplary arrangements the central clip 86 may comprise a plastic body that releasably engages with biased tabs that are included on the engageable portions of the branches of the harness. The tabs or other similar items that are included on the harness may include adjusting buckles 88 or similar structures that enable adjustment of the length of the various branches of the harness 78. Of course this harness construction is exemplary and in other embodiments other approaches may be used.

In the exemplary arrangement at least one branch of the harness is comprised of at least one nonporous flat band of flexible plastic material. The flat band is comprised of a plastic coating that overlies a woven fabric core or similar internal structure. The exemplary plastic coating layer provides continuous smooth surfaces on all sides of the flat band. In exemplary arrangements because the core material is encapsulated by the overlying plastic layer, the bands which comprise the harness do not fray or tear as often happens with woven fiber or other types of harness material.

Also in exemplary embodiments the harness may include loops comprised of the flat band material so as to engage the harness with buckles, clips or similar structures. Such loops may be formed in exemplary embodiments by engaging portions of the band through heat welding. Such heat welding engagement provides a joint that has no gaps or porous areas in which dirt and contaminants may collect. Further in exemplary embodiments the flat band material which comprises the harness is relatively rigid and has material memory which causes the band to return to its original position after it has been deformed to engage a child or is tucked aside for storage. As a result the exemplary material is less likely to kink and tends to remain tangle free compared to woven harnesses. In addition, the plastic band material tends to be stickier and maintain contact with the child so as to allow less relative movement and hold the child more securely in the child seat.

In exemplary embodiments the flat band material of the harness may be comprised of a thermoplastic such as a polyurethane which overlies a core of woven plastic fibers such as nylon, rayon, polyester or other material. Of course this construction is exemplary and in other embodiments other approaches may be used.

Thus, the exemplary embodiments of the child seat described herein can achieve improved operation and capabilities, eliminate difficulties encountered in the use of prior devices, and attain the useful results and benefits described herein.

In the foregoing description, certain terms have been used for brevity, clarity and understanding. However, no unnecessary limitations are to be implied therefrom because such terms are used for descriptive purposes and are intended to be broadly construed. Moreover the descriptions and illustrations herein are by way of examples and the new and useful features are not limited to the exact features shown and described.

Further in the following claims any feature that is described as a means for performing a function shall be construed to encompass any means known to those skilled in the art as being capable of carrying out the recited function and shall not be deemed limited to the particular means shown or described for performing the recited function in the foregoing description, or mere equivalents thereof.

Having described the features, discoveries and principles of the exemplary embodiments, the manner in which they are constructed and operated, and the advantages and useful results attained, the new and useful structures, devices, elements, arrangements, parts, combinations, systems, equipment, operations, methods, processes and relationships are set forth in the appended claims.

We claim:

1. Apparatus comprising:

a child seat including a rectangular body, wherein the body includes a centrally located seat recess configured to receive the rump of a child therein, four disposed corner areas, wherein each corner area includes a respective vertically extending cylindrical body recess, four upper legs, wherein each respective upper leg is separable from the rectangular body and extends in a respective vertically extending cylindrical body recess, four lower legs, wherein each respective lower leg is releasably engaged with a respective upper leg in telescoping relation, and includes a leg lower portion, four releasable latches, wherein each releasable latch is in operative connection with a respective engaged upper leg and lower leg, wherein each latch is selectively operative to releasably hold the respective engaged upper leg and lower leg associated with the respective latch, fixed in a plurality of telescoping positions, four feet, wherein each foot is engaged with a leg lower portion and is configured to be operatively engageable with a floor, wherein each foot includes a disc of relatively hard material, wherein the disc includes a disc top, a disc bottom and a disc periphery, wherein the leg lower portion is in operative engagement with the disc top, a unitary tread layer, wherein the tread layer is comprised of relatively softer material than the disc, and wherein the tread layer extends across the disc bottom, around the disc periphery and above the disc top.

2. The apparatus according to claim 1 wherein each disc includes an annular recess, wherein the annular recess extends inwardly from the periphery, wherein the tread layer extends in the annular recess.

3. The apparatus according to claim 2
wherein the annular recess extends in the disc top,
wherein in the annular recess the disc includes a plurality of foot apertures that extend between the disc top and the disc bottom,
wherein the tread layer extends through each of the plurality of foot apertures.

4. The apparatus according to claim 2
wherein the disc and the tread layer are each comprised of plastic materials,
wherein the disc and tread layer are heat fused in fixed engagement.

5. The apparatus according to claim 2
wherein each foot includes an upward extending stem,
wherein each stem is in fixed engagement with a respective disc,
wherein each leg lower portion includes a stem opening at a bottom thereof,
wherein each stem extends in a respective stem opening.

6. The apparatus according to claim 5
wherein each stem is generally cylindrical,
wherein each stem includes
an alignment projection, wherein the alignment projection extends radially outward from the stem,
wherein each leg lower portion includes an axially extending alignment engaging recess, wherein the alignment engaging recess extends radially through the respective leg lower portion and intersects the respective stem opening,
wherein the respective alignment projection is engaged in the respective alignment engaging recess, whereby the respective foot is held in fixed rotational position relative to the respective leg lower portion.

7. The apparatus according to claim 5
wherein each stem includes a respective resilient radially outward extending locking projection,
wherein each leg lower portion includes a respective stem locking aperture, wherein the stem locking aperture extends through the leg lower portion and is axially disposed and separate from the stem opening,
wherein the respective outwardly extending locking projection extends in the respective stem locking aperture, whereby the respective foot is held in engagement with the respective leg lower portion.

8. The apparatus according to claim 1
wherein each respective telescoping upper leg and lower leg includes one of the upper leg and the lower leg configured as an inside leg and the other of the upper leg and lower leg configured as an outside leg,
wherein the respective latch associated with a respective telescoping upper leg and lower leg includes
a radially outwardly biased positioning projection extending radially outwardly on the inside leg,
a plurality of axially disposed positioning apertures extending on the outside leg, wherein the positioning projection is selectively positionable in engaged relation with each of the respective positioning apertures,
wherein axial length of each respective engaged upper leg and lower leg is changeable by changing the respective aperture in engagement with the respective positioning projection.

9. The apparatus according to claim 1
wherein each respective upper leg includes one of
a body engaging projection and a body engaging aperture,
and the body includes the other of the body engaging projection and the body engaging aperture,
wherein engagement of the body engaging projection and the body engaging aperture releasably holds a respective upper leg in engagement with the body in a respective cylindrical body recess.

10. The apparatus according to claim 1 and further comprising
a releasable harness configured to hold a child in the seat recess,
wherein the harness is comprised of at least one nonporous flat band comprising flexible plastic material that has a continuous smooth surface on all sides thereof.

11. Apparatus comprising:
a child seat including
a rectangular body, wherein the body includes
a centrally located seat recess configured to receive the rump of a child therein, wherein the seat recess includes a seat body bottom at the bottom of the seat recess and is configured to have a child seated therein facing along a direction line, wherein the rectangular body has a width distance perpendicular to the direction line,
four disposed corner areas, wherein each corner area includes a respective vertically extending cylindrical body recess,
four upper legs,
wherein each respective upper leg extends in a respective vertically extending cylindrical body recess,
four lower legs,
wherein each respective lower leg
is engaged with a respective upper leg in telescoping relation, and includes a leg lower portion,
four releasable latches, wherein each releasable latch is in operative connection with a respective engaged upper leg and lower leg,
wherein each latch is selectively operative to releasably hold the respective engaged upper leg and lower leg,
four feet, wherein each foot includes a foot bottom configured to be engageable with a horizontal floor, wherein the seat body bottom extends a height distance above the floor,
wherein each foot further includes
a disc, wherein the disc includes a disc bottom, a disc periphery, and
a disc top, wherein the disc top is in fixed operative engagement with a lower leg portion,
a unitary tread layer, wherein the unitary tread layer extends across the disc bottom, around the disc periphery, and above the disc top,
wherein a ratio of the width distance to the height distance is in the range of about 4:1 to 1.5:1.

12. The apparatus according to claim 11
wherein the disc is comprised of relatively hard material, and
wherein the tread layer is comprised of relatively softer material than the disc and includes the foot bottom.

13. Apparatus comprising:
a child seat including
a rectangular body, wherein the body includes
a centrally located seat recess configured to receive the rump of a child therein,
four disposed corner areas, wherein each corner area includes a respective vertically extending cylindrical body recess, four upper legs,
wherein each respective upper leg extends in a respective vertically extending cylindrical body recess,
four lower legs,
wherein each respective lower leg is operatively engaged with a respective upper leg in telescoping relation, and includes
a leg lower portion,
four releasable latches, wherein each respective releasable latch is in operative connection with a respective operatively engaged upper leg and lower leg,
wherein each latch is selectively operative to releasably hold the respective operatively engaged upper leg and lower leg associated with the respective latch, fixed in a plurality of telescoping positions,
four feet, wherein each foot is operatively engaged with a respective leg lower portion and is configured to be operatively engageable with a floor, wherein each foot includes
a disc of relatively hard material, wherein the disc includes
a disc top, a disc bottom and a disc periphery, wherein the respective leg lower portion is in operative engagement with the disc top,
an annular recess, wherein the annular recess extends inwardly from the disc periphery, extends in the disc top, and
includes a plurality of foot apertures that extend between the disc top and the disc bottom,
a unitary tread layer, wherein the tread layer
is comprised of relatively softer material than the disc, and
extends across the disc bottom, around the disc periphery, above the annular recess of the disc top, and through each of the plurality of foot apertures.

14. Apparatus comprising:
a child seat including
a body, wherein the body includes
a seat recess configured to receive the rump of a child therein,
four upper legs,
wherein each respective upper leg is in operative connection with the body,
four lower legs,
wherein each respective lower leg is operatively engaged with a respective upper leg,
wherein each respective operatively engaged upper and lower leg are operatively configured to be releasably held fixed in a plurality of positions, wherein in each respective one of the plurality of positions the lower leg extends a different distance downward away from the body,
four feet, wherein each respective foot is operatively engaged with a respective lower leg, and wherein each foot includes
a disc, wherein the disc includes
a disc top, a disc bottom, and a disc periphery, wherein the respective lower leg is in operative engagement with the disc,
an annular recess, wherein the annular recess extends inwardly in the disc top from the disc periphery, and
a plurality of foot apertures in the annular recess that extend between the disc top and the disc bottom,
a tread layer, wherein the tread layer
extends across the disc bottom to the disc periphery and through each of the plurality of foot apertures in the annular recess to the disc top.

15. Apparatus comprising:
a child seat including
a rectangular body, wherein the body includes
a centrally located seat recess configured to receive the rump of a child therein,
four disposed corner areas, wherein each corner area includes a respective vertically extending cylindrical body recess,
four upper legs,
wherein each respective upper leg extends in a respective vertically extending cylindrical body recess,
four lower legs,
wherein each respective lower leg is operatively engaged with a respective upper leg in telescoping relation, and includes
a leg lower portion, wherein each leg lower portion includes
a stem opening at a bottom thereof, and
an axially extending alignment engaging recess, wherein the alignment engaging recess extends radially through the respective leg lower portion and intersects the respective stem opening,
four releasable latches, wherein each respective releasable latch is in operative connection with a respective operatively engaged upper leg and lower leg,
wherein each latch is selectively operative to releasably hold the respective operatively engaged upper leg and lower leg associated with the respective latch, fixed in a plurality of telescoping positions,
four feet, wherein each foot is operatively engaged with a respective leg lower portion and is configured to be operatively engageable with a floor, wherein each foot includes
an upward extending stem, wherein each stem
is generally cylindrical,
extends in the stem opening of the respective leg lower portion, and includes
an alignment projection, wherein the alignment projection extends radially outward from the stem, and
wherein the respective alignment projection of the respective stem is operatively engaged in the axially extending alignment engaging recess of the respective leg lower portion,
whereby each respective foot is held in a fixed rotational position relative to the respective leg lower portion,
a disc of relatively hard material,
wherein the disc is in fixed operative engagement with the corresponding upward extending stem of the respective foot,
wherein the disc includes
a disc top, a disc bottom, and a disc periphery,
an annular recess, wherein the annular recess extends inwardly from the disc periphery,
a unitary tread layer, wherein the tread layer
is comprised of relatively softer material than the disc, extends across the disc bottom, around the disc periphery, in the annular recess and above the disc top.

16. Apparatus comprising:

a child seat including a rectangular body, wherein the body includes a centrally located seat recess configured to receive the rump of a child therein, four disposed corner areas, wherein each corner area includes a respective vertically extending cylindrical body recess, four upper legs, wherein each respective upper leg extends in a respective vertically extending cylindrical body recess, four lower legs, wherein each respective lower leg is operatively engaged with a respective upper leg in telescoping relation, and includes a leg lower portion, wherein each leg lower portion includes a stem opening at a bottom thereof, a respective stem locking aperture, wherein the stem locking aperture extends through the leg lower portion and is axially disposed and separate from the stem opening, four releasable latches, wherein each respective releasable latch is in operative connection with a respective operatively engaged upper leg and lower leg, wherein each latch is selectively operative to releasably hold the respective operatively engaged upper leg and lower leg associated with the respective latch, fixed in a plurality of telescoping positions, four feet, wherein each foot is operatively engaged with a respective leg lower portion and is configured to be operatively engageable with a floor, wherein each foot includes an upward extending stem, wherein the stem extends in the stem opening of the respective leg lower portion, and includes a resilient radially outward extending locking projection, wherein the outward extending locking projection extends in the respective stem locking aperture, whereby the respective foot is held in operative engagement with the respective leg lower portion, a disc of relatively hard material, wherein the disc is in fixed operative engagement with the upward extending stem of the respective foot, wherein the disc includes a disc top, a disc bottom, and a disc periphery, an annular recess wherein the annular recess extends inwardly from the disc periphery, a unitary tread layer, wherein the tread layer is comprised of relatively softer material than the disc, extends across the disc bottom, around the disc periphery, in the annular recess, and above the disc top.

17. The apparatus according to claim 16 wherein each stem is generally cylindrical, wherein each stem includes an alignment projection, wherein the alignment projection extends radially outward from the stem, wherein each leg lower portion includes an axially extending alignment engaging recess, wherein the alignment engaging recess extends radially through the respective leg lower portion and intersects the respective stem opening, wherein the respective alignment projection is engaged in the respective alignment engaging recess, whereby the respective foot is held in fixed rotational position relative to the respective leg lower portion.

18. The apparatus according to claim 17 wherein each stem includes a plurality of annularly spaced radially outward extending positioning projections, wherein the positioning projections extend further radially outward with increasing proximity to the disc top, wherein the positioning projections of the respective stem extend in the stem opening and engage an inner annular leg surface of the leg lower portion of the respective lower leg.

19. The apparatus according to claim 16 wherein each stem includes a plurality of annularly spaced radially outward extending positioning projections, wherein the positioning projections extend further radially outward with increasing proximity to the disc top, wherein the positioning projections of the respective stem extend in the stem opening and engage an inner annular leg surface of the leg lower portion of the respective lower leg.

20. The apparatus according to claim 16 wherein each respective telescoping upper leg and lower leg is configured to have one of the upper leg and lower leg be an inside leg and the other of the upper leg and lower leg be an outside leg, wherein the respective latch associated with a respective telescoping upper and lower leg includes a radially outwardly biased positioning projection extending radially outwardly from the inside leg, a plurality of axially disposed positioning apertures extending on the outside leg, wherein the positioning projection is selectively positionable in engaged relation with each of the respective positioning apertures, whereby axial length of each respective engaged upper leg and lower leg is changeable by changing the respective aperture in engagement with the respective positioning projection.

21. The apparatus according to claim 20 wherein the seat recess is configured to have a child seated therein facing along a direction line, wherein the direction line bisects the rectangular body, wherein each respective outside leg of the telescoping upper leg and lower leg includes wherein each annular outside surface includes each of a semi-annular outward facing half and a back half, wherein a center of the outward facing half faces in a facing direction parallel to the direction line and away from the body, wherein the positioning apertures extend in the back half of each respective leg.

22. The apparatus according to claim 21 wherein the rectangular body has a width distance perpendicular to the direction line, and a seat body bottom at a bottom of the seat recess, wherein a bottom of each tread layer of each leg is engageable with a horizontal floor, wherein the seat body bottom extends a height distance above the floor, wherein a ratio of the width distance to the height distance is in the range of about 4:1 to about 1.5:1.

23. The apparatus according to claim 21 and further comprising an annular bushing of unitary plastic construction, wherein the annular bushing includes an inside annular portion that extends inside the outside leg and overlies the inside leg, and an annular step that in transverse cross-section extends perpendicular to the inside annular portion and abuttingly engages an annular edge of the outside leg.

24. The apparatus according to claim 20 and further comprising an annular bushing of unitary plastic construction, wherein the annular bushing includes an inside annular portion that extends inside the outside leg and overlies the inside leg, and an annular step that in transverse cross-section extends perpendicular to the inside annular portion and abuttingly engages the annular edge of the outside leg.

25. The apparatus according to claim 20 wherein each respective upper leg includes one of a body engaging projection and a body engaging aperture, and wherein the body includes the other of the body engaging projection and the body engaging aperture, wherein engagement of the body engaging projection and the body engaging aperture releasably holds the respective upper leg in engagement with the body in a respective cylindrical body recess.

26. The apparatus according to claim 25 and further comprising a releasable harness configured to hold a child in the seat recess, wherein the harness is comprised of at least one flat band comprising flexible plastic material that has a continuous smooth surface on all sides thereof.

27. The apparatus according to claim 26 wherein the at least one band is comprised of a plastic coating layer overlying all sides of a woven fiber core.

28. The apparatus according to claim 27 wherein the at least one band includes a loop, wherein the band is engaged with itself to form the loop by a heat weld that has no gaps or porous areas at the weld.

29. The apparatus according to claim 28 and further including a tray, wherein the tray is releasably engageable with the body.

30. Apparatus comprising:

a child seat including a body, wherein the body includes a seat recess configured to receive the rump of a child therein, four upper legs, wherein each respective upper leg is in operative connection with the body, four lower legs, wherein each respective lower leg is operatively engaged with a respective upper leg, and includes a leg lower portion, wherein each leg lower portion includes a stem opening at a bottom thereof, and an axially extending alignment engaging recess, wherein the alignment engaging recess extends radially through the respective leg lower portion and intersects the respective stem opening, wherein each respective operatively engaged upper and lower leg are operatively configured to be releasably held fixed in a plurality of positions, wherein in each respective one of the plurality of different positions the leg lower portion extends a different distance away from the body, four feet, wherein each foot is operatively engaged with a leg lower portion, wherein each foot includes an upward extending stem, wherein the stem extends in the stem opening of the respective leg lower portion, wherein the stem includes an alignment projection, wherein the alignment projection extends radially outward from the stem, and wherein the alignment projection of the stem is operatively engaged in the axially extending alignment engaging recess of the respective leg lower portion, whereby the respective foot is held in a fixed rotational position relative to the respective leg lower portion, a disc, wherein the disc is in fixed operative engagement with the upward extending stem of the foot, wherein the disc includes a disc bottom, wherein the disc bottom includes a tread layer.

* * * * *